US007540118B2

(12) United States Patent
Jensen

(10) Patent No.: US 7,540,118 B2
(45) Date of Patent: Jun. 2, 2009

(54) FIREBLOCKING DEVICE

(75) Inventor: Geir Jensen, Trondheim (NO)

(73) Assignee: Securo AS, Verdal (NO)

( * ) Notice: Subject to any disclaimer, the term of this patent is extended or adjusted under 35 U.S.C. 154(b) by 231 days.

(21) Appl. No.: 10/518,378

(22) PCT Filed: Jul. 4, 2003

(86) PCT No.: PCT/NO03/00238

§ 371 (c)(1),
(2), (4) Date: Feb. 8, 2005

(87) PCT Pub. No.: WO2004/004837

PCT Pub. Date: Jan. 15, 2004

(65) Prior Publication Data

US 2005/0246973 A1 Nov. 10, 2005

(30) Foreign Application Priority Data

Jul. 5, 2002 (NO) ..... 20023283

(51) Int. Cl.
*E04C 2/42* (2006.01)
*E04B 1/62* (2006.01)
*A62C 2/06* (2006.01)

(52) U.S. Cl. ..... 52/232; 52/95; 52/302.7; 169/70; 454/257

(58) Field of Classification Search ..... 52/232, 52/95, 198, 199, 220.8, 317, 660–676, 1, 52/302.1, 302.3, 302.7; 454/257, 369; 169/70, 169/62, 54, 45, 46; 165/10; 110/336
See application file for complete search history.

(56) References Cited

U.S. PATENT DOCUMENTS

| | | | | | |
|---|---|---|---|---|---|
| 2,279,791 | A * | 4/1942 | Lamb | 169/48 |
| 3,976,825 | A * | 8/1976 | Anderberg | 174/151 |
| 4,093,818 | A * | 6/1978 | Thwaites et al. | 174/505 |
| 4,121,563 | A * | 10/1978 | Gold | 126/116 A |
| 4,493,945 | A * | 1/1985 | Feldman | 174/68.3 |
| 4,945,015 | A * | 7/1990 | Milner et al. | 523/179 |
| 5,344,106 | A * | 9/1994 | Beele | 248/56 |
| 5,398,467 | A | 3/1995 | Ricq et al. | |
| 5,404,687 | A * | 4/1995 | Blake et al. | 52/600 |
| 5,750,927 | A * | 5/1998 | Baltazar | 174/68.3 |
| 5,811,731 | A * | 9/1998 | Jacques et al. | 174/68.3 |
| 6,061,993 | A * | 5/2000 | Bendixen et al. | 52/783.19 |
| 6,184,269 | B1 * | 2/2001 | Abu-Isa et al. | 523/179 |
| 6,572,948 | B1 | 6/2003 | Dykhoff | |
| 6,752,714 | B1 * | 6/2004 | Mann | 454/369 |
| 7,018,699 | B2 * | 3/2006 | Dykhoff | 428/76 |

(Continued)

FOREIGN PATENT DOCUMENTS

DE 19524766 1/1996

(Continued)

*Primary Examiner*—Robert J Canfield
*Assistant Examiner*—Jessie Fonseca
(74) *Attorney, Agent, or Firm*—Dennison, Schultz & MacDonald

(57) ABSTRACT

Fireblocking device for preventing transfer of fire through ventilating apertures or similar passages, in openings for thermal fire ventilation, in ventilation ducts, in process plants or in vented facade exteriors, in vented fire blankets, vented fire protective curtains or vented protective screens against explosions. The device includes a combination of a heat absorbing and heat storing body, and an element which includes and/or adsorbs and intumescent material.

9 Claims, 1 Drawing Sheet

U.S. PATENT DOCUMENTS

| | | | | |
|---|---|---|---|---|
| 7,080,486 | B2 * | 7/2006 | Radke et al. | 52/98 |
| 2002/0178664 | A1 * | 12/2002 | Dykhoff | 52/220.8 |

FOREIGN PATENT DOCUMENTS

| | | | | |
|---|---|---|---|---|
| DE | 19649126 | | | 5/1998 |
| DK | 140856 | | | 11/1979 |
| GB | 2107183 | A | * | 4/1983 |
| GB | 2159051 | A | * | 11/1985 |
| GB | 2334674 | A | * | 9/1999 |
| GB | 2334675 | A | * | 9/1999 |
| GB | 2361868 | A | * | 11/2001 |

* cited by examiner

FIREBLOCKING DEVICE

This application is a filing under 35 USC 371 of PCT/NO2003/000238 filed Jul. 4, 2003.

BACKGROUND OF THE INVENTION

1. Field of the Invention

The invention relates to a fire blocking device as indicated in claim 1, in particular for blocking flames, which can be transferred through ventilation grates and similar apertures with air transfer. With "fireblocking device" is here ment a passive element, open for air transfer, which prevents the spreading of fire by penetration of flames, heat conduction, convection or radiation.

2. Description of Related Art

Open flame arresters are known, which function as heat sink for explosive combustion or short-lived fireballs. They are arranged open, so that air transfers, but not flames. They are often made of steel, either as perforated plates or mesh or as steel strip bodies pressed together, and similar. The function of arresting deflagration combustion first became known as Davy's net in 1815, used by Sir Humphrey Davy, and such elements have been used for different industrial purposes, such as for engine block ventilation and in gas production facilities, as explosion flame shields for personal safety offshore and similar.

Building fires are in some instances transferred by flames spreading through openings and channels containing or being adjacent to combustible elements or materials.

An example of such a risk in buildings are the inlets to ventilated, non-heated roofs (voids) or attics, where flames on the outside of a wall or from a window, can spread through ventilators in eaves and into combustible structures in attics. Such areas are not easy accessible, and fires that take hold here, often result in dramatic consequences.

Such fire spreading is hard to stop, and thus far one has not considered it possible to combine the demand for venting and fire resistance. Activateable dampers are considered to be too unsafe because flames can pass for minutes before closing, because of the weathering, because of mechanical and movable parts and because of dry materials, which can ignite before closing.

From U.S. Pat. No. 5,565,274 (Perrone et al.) it is known for instance an attic hatch, which comprises intumescent material and which is closed with a heat-triggered activator.

From U.S. Pat. No. 5,811,731 (Jacques et al.) it is known to line an intumescent material around a cable channel. There are vents for conducting excess heat from cables and a steel grille, which will be disintegrated in case of a fire.

Known patents and solutions for preventing fire spreading in openings for air passages have a weakness in that, during a period before they are activated, they allow flames to pass through and ignite combustible gas or easily ignitable solid materials on the side that shall be protected. Some of them also leave cracks, which make flame tongues and smoke spreading possible, even when they are closed.

SUMMARY OF THE INVENTION

The main object of the invention is to create a passive fireblocking device for air passages, which instantly, i.e. from the first millisecond and until the openings are shut, can prevent fire from spreading via the air passage from one area with a fire, to a room, duct or other building or machine voids, where fire can cause damage and/or spread further to other and vulnerable areas with combustible materials that can spread a fire.

In particular, it is an object to create an element, which can be built into vents in buildings, such as in eaves, where air passage is required, to prevent fire from spreading through such passages or other passages, which must not spread fire.

It is also a particular object to prevent ignition of combustible gas or combustible solid material on the protected side from the very first impact of heat, conducted heat or deflagration burning from the outside, and through the entire period, the element is designed to perform.

The invention is directed to a fireblocking device for continuously preventing in a flame impact period, the transfer of flames through ventilating apertures or similar passages, in openings for thermal fire ventilation, in ventilation ducts, in process plants or in vented facade exteriors. The device is characterized by at least one permeable flame blocking and heat absorbing and heat accumulating grille body to stop flames during instant and constant flame impact in the initial phase of flame impact, and at least one permeable element containing and/or incorporating an intumescent material, for permanent fire stopping in the last chase of the flame impact period.

The term "grill body" is used to denote any that allows flow through a plurality of evenly distributed openings, where each opening is small compared to the total cross section of the body.

Examples of applications of the invention are as vents in walls, bulkheads, tanks, ducts, openings for natural ventilation, in processing plants, vented facade exteriors, vented fire blankets, open fire protective curtains or open protective screen against explosions.

When used for instance in vented roofs or vulnerable eaves, the fireblocking devices according to the invention will prevent flame spreading without blocking the air passage. At the same time, birds, insects, leaves and sparks are kept out. The air velocity may be reduced in regard to previous venting gaps between soffit boards, but this may be an advantage, as new research indicates that former regulations were exaggerated and thus not very energy saving.

The fireblocking devices according to the invention can be produced at low cost with cheap materials. Installation of the fireblocking device or post-installation with replacement of existing ventilating grilles, respectively, can take place without any particular training and in an easy manner. Furthermore, it is possible to make the fireblocking device according to the invention maintenance-free and nearly everlasting.

Additional advantageous features of the invention include a three-dimensional heat absorbing and heat storing body, a cylindrical fireblocking device, a heat absorbing and heat storing body containing metal pipes filled with liquid, minerals or mixtures thereof, a heat absorbing and heat storing body comprising honeycomb-patterned sheet-metal, which can be arranged into a frame, which includes a thermal break, a heat adsorbing perforated body positioned downstream of the permeable element, and which contains the intumescent material, positioned towards the flame front, and a fireblocking device provided as sheet material. These will be described further in connection with an example of embodiment, which discloses further details of the invention.

BRIEF DESCRIPTION OF THE DRAWINGS

The invention will be further described below with reference to the drawings, where.

DESCRIPTION OF THE PREFERRED EMBODIMENTS

Figure 1A:
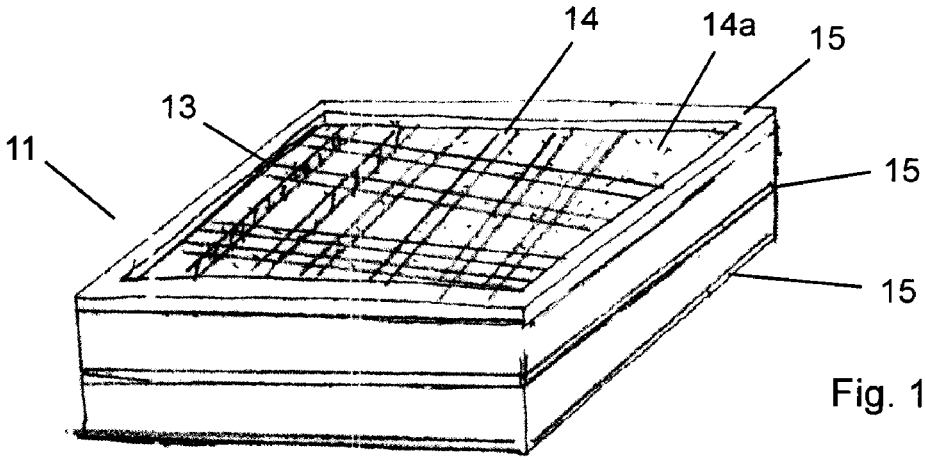
FIG. 1*a* illustrates a schematic perspective view of an embodiment of the invention viewed from above.
Figure 1B:
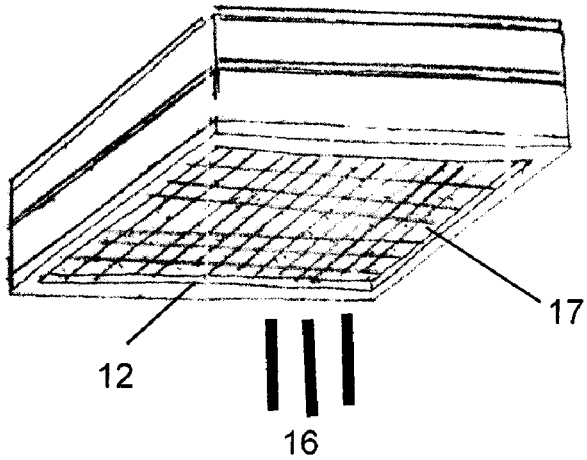
FIG. 1*b* illustrates a schematic perspective view of the embodiment of the invention shown in FIG. 1*a*, viewed from below, and FIG. 2 correspondingly illustrates a schematic cross-section through the element in FIG. 1, in a possible application.

FIGS. 1*a* and 1*b* show a fireblocking device 11 according to the invention, which is made up of a lower, rectangular plate 12 of a grille that is treated with an intumescent material, disposed on the inlet side of the ventilating device, and an upper corresponding rectangular plate 13 of a heat absorbing and heat storing material in the form of perforated metal or metal pipes 14 filled with liquids, minerals or mixtures thereof, through which plate 13 air can flow, and which is disposed on the outlet side of the ventilating device. Over this, there is placed a rim frame 15 of a heat-insulating material, which can interrupt a heat bridge. Such a heat-insulating frame 15 can alternatively or additionally be placed between the two plates 12 and 13.

This embodiment requires an upwardly directed flame in the direction 16 from below, as will be apparent from the following.

The two elements can have an arbitrary shape, depending on the field of application. They can also be made as plate material intended for division into pieces at the location of use. The arrangement of the two parts of the fireblocking device as indicated above, gives particular advantages because the intumescent material will be exposed to flames with maximum temperature. But it is also possible that the basic effect of the invention can be achieved in that the heat absorbing and heat storing element first and the tightening element lies behind this, in the direction of the flow.

It may also be possible to combine the two elements so that the heat sink effect and the tightening effect is obtained totally or partially by the same element.

The lower grille plate 12 is manufactured in a generally known manner as a perforated body of, or coated with, or treated with an intumescent material 17, i.e. a material that swells and tightens all openings when heated. This material may cover for instance 10-20% of the flow-through area. The intumescent material can be based on high density polyethylene in hard phase of thermoplastic and chlorinated polyethylene and/or silicone rubber in soft phase. The material contains typical binding agent, thermal stabilizing material, fire retardant additive, and crust forming additives.

The lower grille plate 12 can also be manufactured as a metal grille with an intumescent material embedded in pockets or voids.

The upper mesh 13 can be one or more perforated plates, a honeycomb-shaped grid of steel plate, pipe metal filled with liquid, a body mainly comprised of coiled or pressed together metal threads or bands, possibly combined with small stones, steel pellets or heat conduction contact with another material 14*a* that has sufficient thermal conductivity and heat storage capacity.

A fireblocking device according to the invention can be used in various applications. It is suitable for buildings, especially in connection with vented attics and as ventilating grilles for ducts and voids that contains combustible material, or which can transfer flames to other combustible structures. Additional fireblocking devices according to the invention can be arranged after one another in a duct or in a transition area.

Examples of applications of the invention are vents in walls, bulkheads, tanks, ducts, openings for natural ventilation, in processing plants, vented facade exteriors, vented fire blankets, open fire protective curtains or open protective screens against explosions.

Fire blanket involves a fabric/tarpaulin/curtain in the form of a netting, where a part of the netting is heat absorbing and another part is intumescent. It can be used to extinguish car and house fires and to protect persons against fire. In this way, the blanket is light, and when it is pulled over a burning object, pressure does not increase—something which otherwise makes it impossible to use tight fire blankets—and fire does not slip through. When it becomes tight by the intumescent part and thus is affected by heat impetus, one has had the time to get it well secured in place and fastened, and the fire is smothered by its own smoke.

The safety curtains resemble fire blankets and is usually transparent, but protect persons against heat radiation from explosions or fires in the industry, in fire experiments, in laboratories or in fire demonstrations in auditoriums. Safety curtains can be used where sound, visibility, smell or pressure balancing—or all—is required, simultaneously with fire protection for persons or values.

Known techniques for protecting persons against explosions by combustion are very heavy constructions of concrete, or guiding the combustion front and the pressure wave into the open or into large volumes of air that perform as a buffer. The first technique may fail in powerful explosions, as well as being expensive and inconvenient. The latter does not provide protection against heat radiation and flaming combustion, only against the pressure impact. The present invention as a protective screen involves pressure-reducing air passages, pressure-reducing movable curtains, no passage of heat radiation and a totally gas-tight patition if the explosion is succeeded by fire. The protective screen against explosion resembles a safety curtain, but has the necessary mechanical design to withstand an explosion.

The advantages of a fireblocking device according to the invention can be summarized as follows:

No mechanical movable parts

Figure 2:
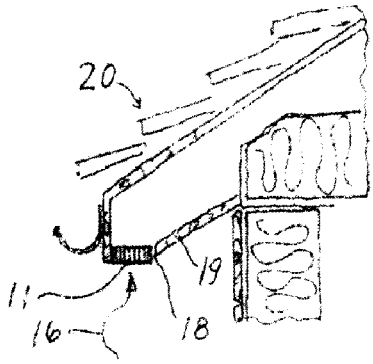

It can be installed into fire barriers, protective hoods, pipes, ducts, vented dressings, vented roofs and attics It prevents fire spreading by heat convection, instantaneously and during the entire fire resistance period It prevents fire spreading by heat radiation, instantaneously and during the entire fire resistance period It prevents fire spreading by heat conduction, instantaneously and during the entire fire resistance period It is non-combustible It prevents fire spreading by explosion combustion, diffuse flame combstion and fire ball It becomes gas tight from impact of heat from fire It can be cleaned by flushing It can be post-installed into existing constructions FIG. 2 shows an example of a possible field of application, where a fireblocking device 11, as shown in FIG. 1, is built into the ventilating aperture 18 in a soffit at eaves 19 under a roof 20.

What is claimed is:

1. A ventilation device for passing air therethrough, and including an upstream side and a downstream side, the ventilation device including a passive fireblocking means comprising:

at least one grille body on the upstream side comprising a plurality of evenly distributed openings permitting air flow therethrough, the grille body being formed of or coated with an intumescent material; and adjacent to and downstream from the at least one grille body, at least one thermally conductive metal mesh permitting air flow therethrough, wherein the metal mesh comprises metal pipes filled with liquids, minerals or mixtures thereof to provide heat storage capacity, and wherein the intumescent material swells when exposed to sufficient heat to close the evenly distributed openings, and the metal mesh has a capacity for heat storage.

2. Fireblocking ventilation device according to claim 1, wherein the metal mesh is three-dimensional.

3. Fireblocking ventilation device according to claim 1, wherein the metal mesh is rectangular in cross-section.

4. Fireblocking ventilation device according to claim 1, wherein the metal mesh comprises stones or steel pellets to provide heat storage capacity.

5. Fireblocking ventilation device according to claim 1 wherein the grille body and the metal mesh are arranged in a frame.

6. Fireblocking ventilation device according to claim 5, wherein an insulating material is provided between the grille body and the metal mesh to serve as a thermal break.

7. Fireblocking ventilation device according to claim 1, wherein the grille body is oriented below the metal mesh and positioned towards a potential source of flame.

8. Fireblocking ventilation device according to claim 1, in a form of a fire blanket or curtain.

9. Fireblocking ventilation device according to claim 1, wherein the intumescent material comprises a hard phase high density polyethylene and a soft phase comprising at least one of chlorinated polyethylene and silicone rubber.

* * * * *